US010743097B1

(12) United States Patent
Cho et al.

(10) Patent No.: US 10,743,097 B1
(45) Date of Patent: Aug. 11, 2020

(54) BIDIRECTIONAL SPEAKER USING BAR MAGNETS

(71) Applicant: Resonado Inc, South Bend, IN (US)

(72) Inventors: Leeg Hyun Cho, Gyeonggi-do (KR); Youngil Cho, Chicago, IL (US); Christian Femrite, Westminster, CO (US)

(73) Assignee: Resonado Inc., South Bend, IN (US)

( * ) Notice: Subject to any disclaimer, the term of this patent is extended or adjusted under 35 U.S.C. 154(b) by 0 days.

(21) Appl. No.: 16/659,369

(22) Filed: Oct. 21, 2019

Related U.S. Application Data

(63) Continuation of application No. 62/809,866, filed on Feb. 25, 2019.

(51) Int. Cl.

| | |
|---|---|
| ***H04R 1/24*** | (2006.01) |
| ***H04R 7/16*** | (2006.01) |
| ***H04R 9/02*** | (2006.01) |
| ***H04R 9/04*** | (2006.01) |
| ***H04R 9/06*** | (2006.01) |

(52) U.S. Cl.
CPC ..... *H04R 1/24* (2013.01); *H04R 7/16* (2013.01); *H04R 9/025* (2013.01); *H04R 9/04* (2013.01); *H04R 9/06* (2013.01); *H04R 2400/11* (2013.01)

(58) Field of Classification Search
CPC . H04R 1/24; H04R 7/16; H04R 9/025; H04R 9/04; H04R 9/06; H04R 2400/11
USPC ..... 381/150
See application file for complete search history.

(56) References Cited

U.S. PATENT DOCUMENTS

| | | | | |
|---|---|---|---|---|
| 2005/0220320 | A1* | 10/2005 | Kim | H04R 9/025 381/396 |
| 2007/0147651 | A1* | 6/2007 | Mitobe | H04R 9/025 381/396 |
| 2014/0363034 | A1* | 12/2014 | Kim | H04R 1/24 381/162 |
| 2017/0034631 | A1* | 2/2017 | Wang | H04R 9/045 |

* cited by examiner

*Primary Examiner* — Sean H Nguyen
(74) *Attorney, Agent, or Firm* — Geeta Kadambi; Riddhi IP LLC

(57) ABSTRACT

A speaker comprising a frame; a first magnetic body and a second magnetic body each coupled to the frame and spaced apart by a predetermined distance from each other to form a gap, wherein the first magnetic body and the second magnetic body are arranged such that opposite polarities of the first magnetic body and the second magnetic body are provided at adjacent lateral positions; a first diaphragm; a second diaphragm; and a first voice coil plate having at least one voice coil wound on and coupled to the voice coil plate, the first voice coil plate being located in the gap between the opposite polarities of the first magnetic body and the second magnetic body, wherein the first voice coil plate is coupled to the first diaphragm and second diaphragm.

7 Claims, 13 Drawing Sheets

BIDIRECTIONAL SPEAKER USING BAR MAGNETS

CROSS RELATED APPLICATION

This application claims priority to Provisional application 62/809,866 filed on 25 Feb. 2019. We incorporate by reference all the limitations in its entirety of the said application in this instant application.

FIELD OF INVENTION

The present technology relates to a speaker capable of producing bidirectional sound.

BACKGROUND

Conventional cone-type speakers usually have a cylindrical shape and use a cylindrical permanent magnet. However, such a structure results in the speaker having a substantial thickness which is not conducive to the current trend of miniaturization of electronics. Furthermore, if sound is required to be produced in more than one direction, two different speakers are often used together, which results in an unwieldy speaker system. There exists a need to produce a more compact speaker, and in particular, a bidirectional speaker capable of producing sound in two directions.

SUMMARY

The instant disclosure relates to a bidirectional speaker. According to aspects of the present invention, there is provided a speaker comprising: a frame; a first magnetic body and a second magnetic body each coupled to the frame and spaced apart by a predetermined distance from each other to form a gap, wherein the first magnetic body and the second magnetic body are arranged such that opposite polarities of the first magnetic body and the second magnetic body are provided at adjacent lateral positions; a first diaphragm; a second diaphragm; and a first voice coil plate having at least one voice coil wound on one or both sides of, and coupled to the voice coil plate, the first voice coil plate being located in the gap between the opposite polarities of the first magnetic body and the second magnetic body, wherein the first voice coil plate is coupled to the first diaphragm and second diaphragm.

The second diaphragm of the speaker may be coupled to an opposite end of the first coil plate as the first diaphragm. The second diaphragm may be a same or different size, may be a same or different shape, and may be a same or different material relative to the first diaphragm.

The speaker may further comprise at least one additional voice coil plate; wherein the at least one additional voice coil plate has at least one voice coil wound on one or both sides of, and coupled to said additional voice coil plate, and wherein the at least one additional voice coil plate is coupled to the first diaphragm and the second diaphragm. The additional voice coil plate(s) may be located in the gap between the first magnetic body and the second magnetic body.

The speaker may further comprise a specified number, N, additional magnetic bodies coupled to the frame, wherein each additional magnetic body and its respective previous magnetic body are spaced apart by a predetermined distance from each other to form a gap, wherein each additional magnetic body and its respective previous magnetic body are arranged such that opposite polarities of each additional magnetic body and its respective previous magnetic body are provided at adjacent lateral positions, and wherein the at least one additional voice coil plate is located in the gap between each additional magnetic body and its corresponding previous magnetic body; wherein on each additional voice coil plate included, there is at least one voice coil wound on and coupled to said additional voice coil plate. Each gap defined by the magnetic bodies should contain at least one such voice coil plate with at least one voice coil wound on one or both sides of, and coupled to said voice coil plate.

In all embodiments of the speaker, both those already mentioned and to be mentioned later in this patent, each voice coil may be comprised of any electrically-conductive material, including but not limited to, any variant of copper wire, printed circuit board, flexible printed circuit board, or other conductive metal or alloy.

The speaker may further comprise a double-sided infinite baffle arranged around peripheries of the first diaphragm and second diaphragm to acoustically separate sounds produced by the first diaphragm from sounds produced by the second diaphragm. This double-sided infinite baffle may also be made hollow with a specified internal volume to provide for an acoustic enclosure.

The speaker may instead further comprise an enclosure configured to guide sound produced by the first diaphragm and sound produced by the second diaphragm in substantially the same direction. The speaker may not comprise a speaker damper.

BRIEF DESCRIPTION OF DRAWINGS

Exemplary embodiments of the present invention are described with reference to the accompanying drawings, in which.

Reference will now be made in detail to the embodiments of the present invention, examples of which are illustrated in the accompanying drawings, wherein like reference numerals refer to like elements throughout.

DETAILED DESCRIPTION

Figure 1:
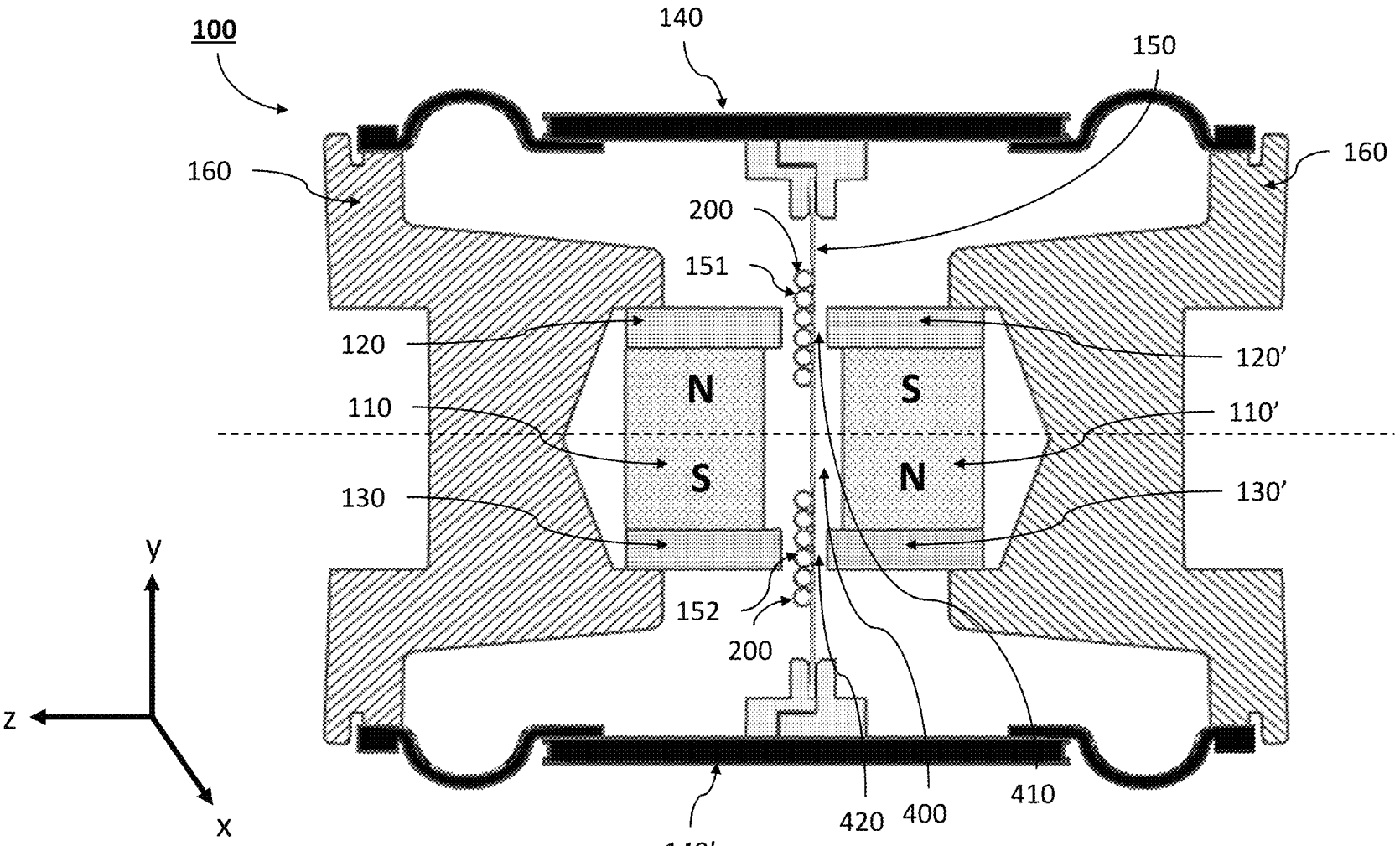
FIG. 1 is a schematic cross-sectional view of a bidirectional speaker according to an embodiment of the invention.

Embodiments of the invention provide a bidirectional speaker 100 that is a speaker 100 which can emit sound simultaneously in two directions. FIG. 1 is a cross-sectional view of a speaker 100 in accordance with embodiments of the present invention. As shown in FIG. 1, the speaker 100 has a first diaphragm 140, a second diaphragm 140', a voice coil plate 150 and a frame 160. The speaker 100 also has a first magnetic body 110 and a second magnetic body 110'. In this example, the first magnetic body 110 and second magnetic body 110' each comprise permanent bar magnets, however other suitable types of magnetic body 110,110' may be used. Each the first magnetic body 110 and second magnetic body 110' are magnetized in a vertical direction along their thickness, in this case along the y-axis. The magnetic bodies 110, 110' are positioned a predetermined distance apart in order to form a gap 400 between them. In this case, the gap 400 extends along the z-axis, orthogonal to the direction of magnetization of the first and second magnetic bodies 110, 110'. The first and second magnetic bodies 110, 110' are arranged and orientated such that each polarity of the first magnetic body 110 is located laterally opposite the opposite polarity of the second magnetic body 110', separated by the gap. That is, the north pole of the first magnetic body 110 is located laterally opposite the south pole of the second magnetic body 110', separated by the gap 400, while the south pole of the first magnetic body 110 is located laterally opposite the north pole of the second magnetic body 110', also separated by the gap 400. The north and south poles have been labelled "N" and "S" in the figures respectively, as per convention.

The magnetic bodies 110, 110' are coupled to the frame 160, as are the first and second diaphragms 140, 140'. A flat voice coil plate 150 is located in the gap 400 between the first magnetic body 110 and the second magnetic body 110' such that the first magnetic body 110 and second magnetic body 110' are adjacent opposite faces of the voice coil plate 150. The voice coil plate 150 extends in a plane orthogonal to the z-axis. The voice coil plate 150 is arranged so that it is free to move in a vertical direction orthogonal to the horizontal gap 400 between the first and second magnetic bodies 110, 110'. In FIG. 1, this means the voice coil plate 150 is free to move along the y-axis in either direction.

A voice coil 200 is wound on and coupled to the voice coil plate 150. An upper portion 151 and a lower portion 152 of the voice coil 200 are each located in the gap between the first magnetic body 110 and second magnetic body 110', and hence are located in the magnetic field induced in the gap 400 between the first magnetic body 110 and second magnetic body 110'. The voice coil plate 150 is described in more detail later, in relation to FIGS. 2*a* and 2*b*.

An upper end of the voice coil plate 150 proximate the upper portion 151 of the voice coil 200 is coupled to the first diaphragm 140 while a lower end of the voice coil plate 150 proximate the lower portion 152 of the voice coil 200 is coupled to the second diaphragm 140'. Both diaphragms 140, 140' are coupled orthogonally to the voice coil plate 150.

In the embodiment shown in FIG. 1, the first diaphragm 140 and second diaphragm 140' are arranged parallel to each other, with the first diaphragm 140 located vertically above the second diaphragm 140', along the y-axis. The voice coil plate 150 is located between the first diaphragm 140 and the second diaphragm 140'. However, it should be noted in some embodiments that the first diaphragm 140 and second diaphragm 140' may not be exactly parallel, but rather may be substantially parallel. In some examples the first diaphragm 140 and/or the second diaphragm 140' may not be flat but may instead be curved to some degree, which can allow the directivity of the audio output of the speaker to be manipulated.

FIG. 1 also shows optional upper plates 120, 120' and lower plates 130, 130', which act as magnetic yokes and which are coupled to respective upper and lower parts of the first and second magnetic bodies. The upper 120, 120' and lower 130, 130' plates are arranged to modify the magnetic field created by the first and second magnetic bodies 110, 110'. For this purpose, the upper and lower plates 120, 120', 130, 130' have a greater width than the first and second magnetic bodies 110, 110'. As a result, the gap 410 between the respective upper plates 120, 120' and the gap 420 between the respective lower plates 130, 130' is smaller than the gap 400 between the magnetic bodies 110, 110'. The upper 120, 120' and lower 130, 130' plates thereby focus the magnetic flux on the upper portion 151 and lower portion 152 of the voice coil 200. Though in this embodiment, plates 120 and 120', as well as plates 130 and 130' are separate pieces, in other embodiments of the invention it is possible that 120 and 120' may be combined into one plate, and that 130 and 130' may be combined into one plate.

Figure 2A:
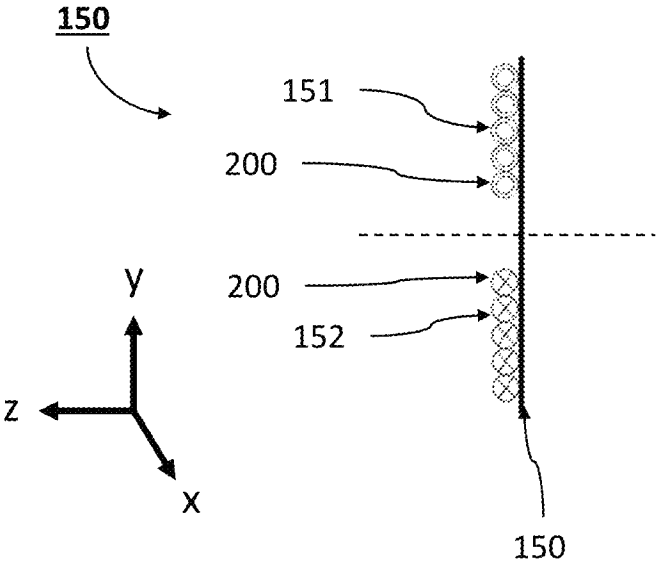
FIG. 2*a* is a schematic view of the voice coil plate of the speaker of FIG. 1 viewed along the x-axis of FIG. 1.
Figure 2B:
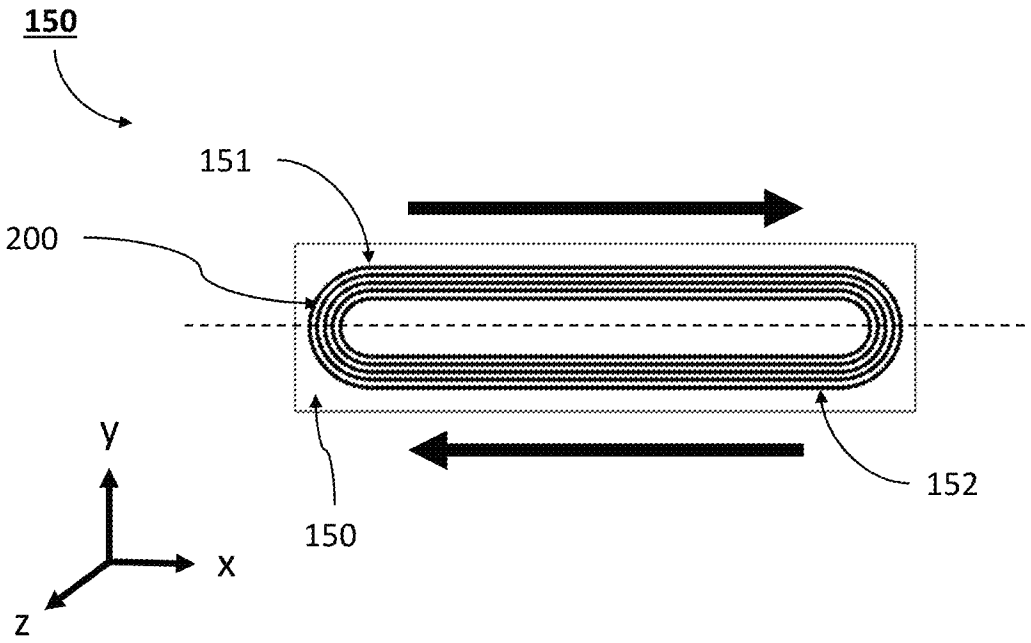
FIG. 2*b* is a schematic view of the voice coil plate of FIG. 2*a* viewed along the z-axis.
Figure 2C:
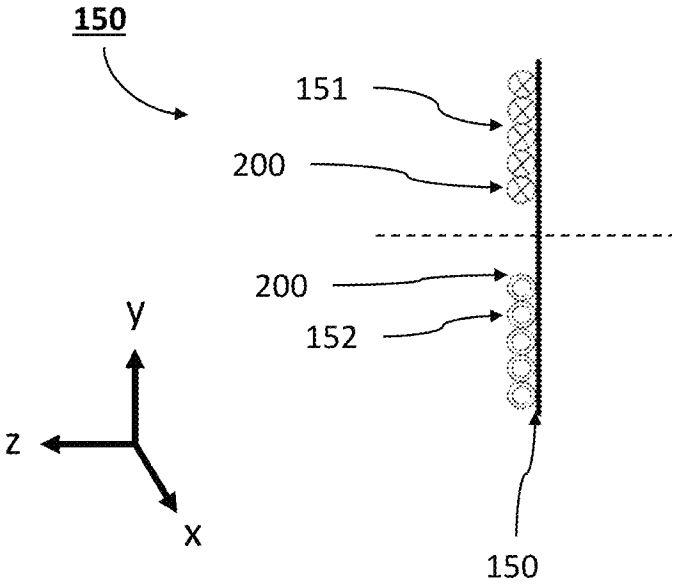
FIG. 2*c* is a schematic view of the voice coil plate of FIG. 2*a*, with current flowing in the opposite direction.
Figure 2D:
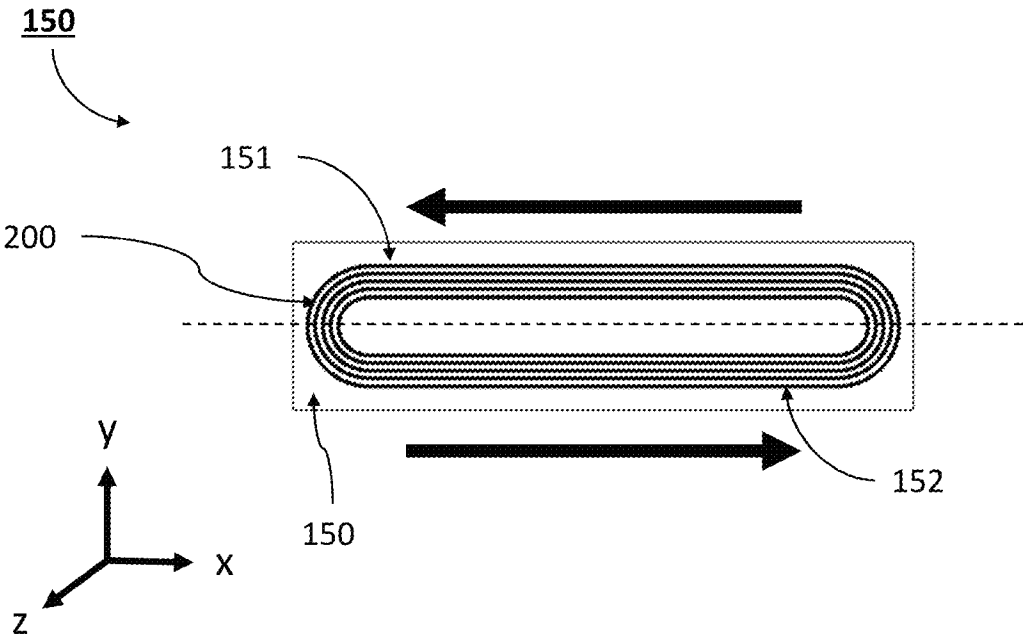
FIG. 2*d* is a schematic view of the voice coil plate of FIG. 2*c* viewed along the z-axis.

FIGS. 2*a* and 2*b* show the voice coil plate 150 of FIG. 1 along the x-axis and the z-axis of FIG. 1 respectively. In FIGS. 2*a* and 2*b*, a current is flowing around the voice coil 200 in a first, clockwise direction, as indicated by the dot and cross notation in FIG. 2*a* and the arrows in FIG. 2*b*. FIGS. 2*c* and 2*d* are identical to FIGS. 2*a* and 2*b* respectively, except that the current is flowing around the voice coil 200 in a opposite, anti-clockwise direction, as indicated by the dot and cross notation and the arrows.

As shown in FIGS. 2*a* and 2*b*, the voice coil 200 is wound on and coupled to the voice coil plate 150. FIGS. 2*a* and 2*b* show one voice coil 200 coupled to one side of the voice coil plate 150. However in other examples, the voice coil 200 may be coupled to both opposite sides of the voice coil plate 150. In other examples, two or more voice coils 200 may be coupled to the voice coil plate 150. These may be coupled on the same or opposite sides of the voice coil plate 150. Alternatively or in addition, one or more voice coils 200 may be located within the voice coil plate 150, for example embedded within the voice coil plate 150. Each voice coil 200 may be made from a variety of conductive materials including, but not limited to, any kind of wire, printed circuit board, flexible printed circuit board, or otherwise. A ferrofluid may be used in conjunction with the voice coil 200.

FIGS. 2*a* and 2*b* show the upper portion 151 and a lower portion 152 of the voice coil 200. Current passing around the voice coil 200 flows through the upper portion 151 in substantially the opposite direction to current flowing through the lower portion 152. When the direction of the current flowing around the voice coil 200 is reversed, the flow of current through the upper portion 151 and the lower portion 152 is reversed. This is indicated by the change in direction of the arrows between FIG. 2*b* and FIG. 2*d*.

The voice coil plate 150 is inserted into the gap 400 between the first and second magnetic bodies 110, 110' such that upper and lower portions 151, 152 of the voice coil 200 are positioned between the upper plates 120, 120' and between the lower plates 130, 130' respectively. That is, the upper portion 151 of the voice coil 200 is located in the gap 410 between the upper plates 120, 120' while the lower portion 152 of the voice coil 200 is located in the gap 420 between the lower plates 130, 130'.

Figure 3A:
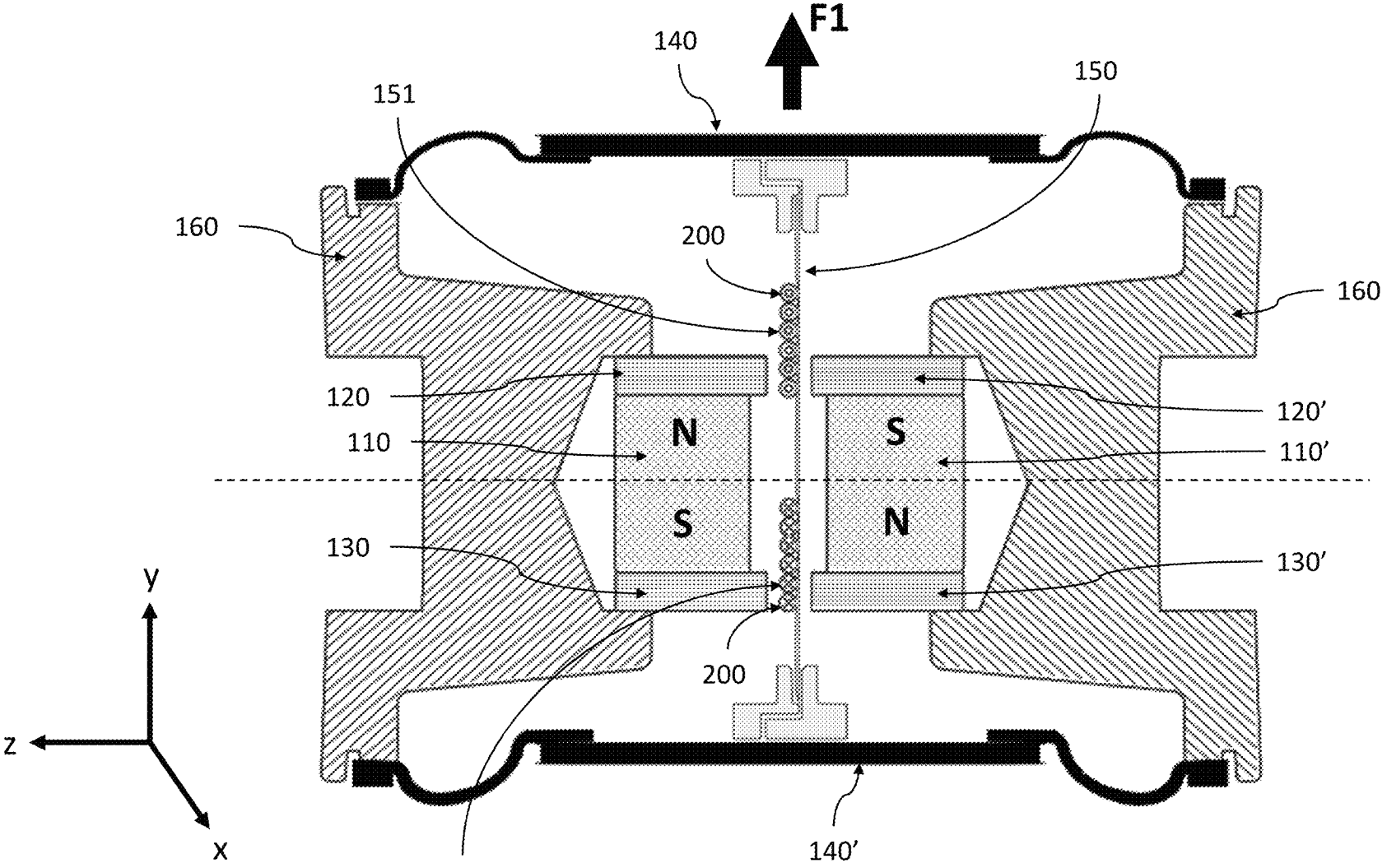
FIG. 3*a* is a schematic cross-sectional view of the bidirectional speaker when the bidirectional speaker of FIG. 1 has the same electrical current flow as FIGS. 2*a* and 2*b*.
Figure 3B:
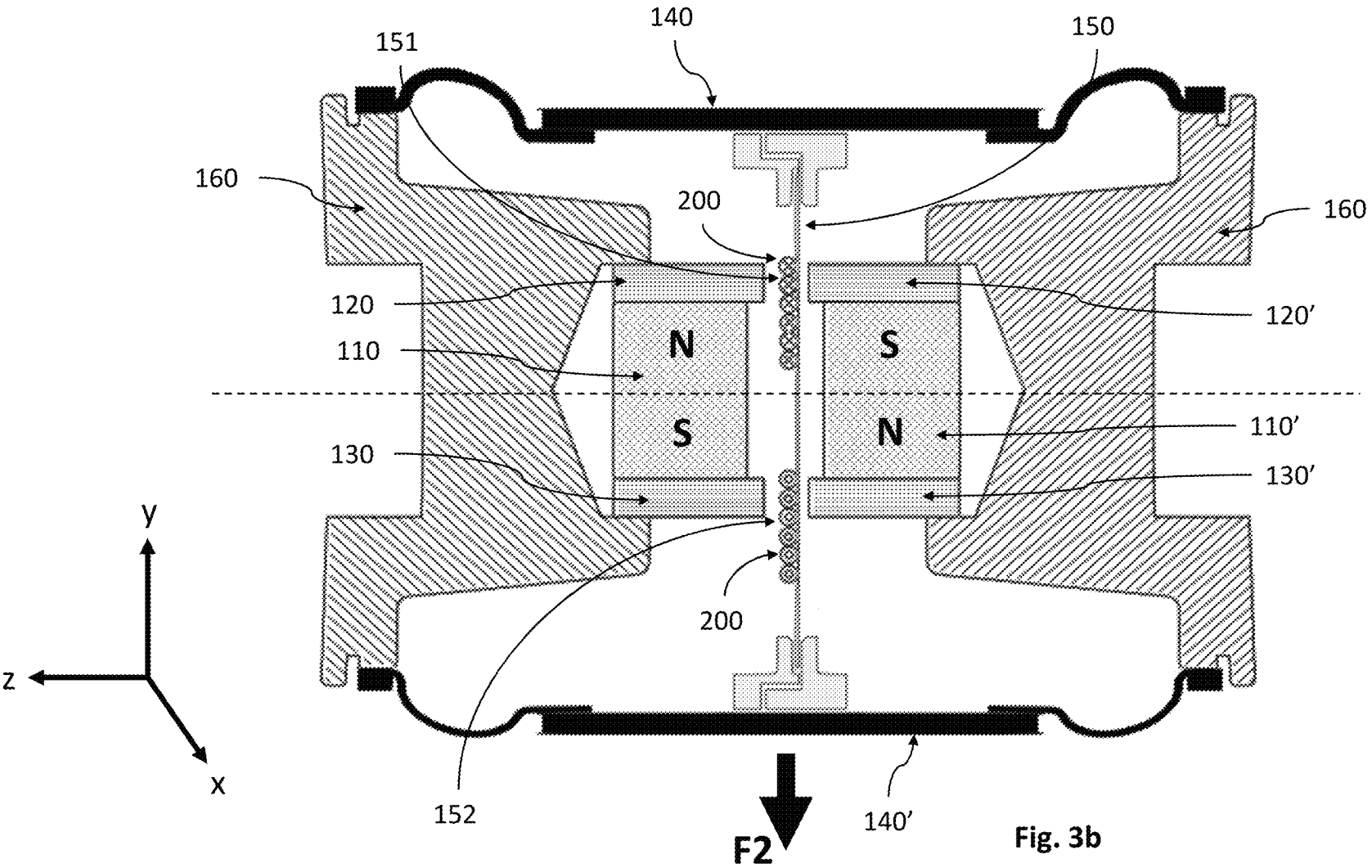
FIG. 3*b* is a schematic cross-sectional view of the bidirectional speaker when the bidirectional speaker of FIG. 1 has the same electrical current flow as FIGS. 2*c* and 2*d*.

FIGS. 3*a* and 3*b* illustrate the speaker 100 of FIG. 1 in operation. An electric current generated by a speaker driving circuit (not shown) is supplied to the voice coil 200 fixed at the voice coil plate 150. The current flowing through the voice coil interacts with the permanent magnetic field induced between the first magnetic body 110 and second magnetic body 110', thereby generating a force according to Fleming's left-hand rule that vibrates the coil plate 150 and the first and second diaphragms 140, 140' fixed thereto. Consequently, the vibration of the diaphragms 140, 140' causes sound to be emitted from the speaker, as indicated by the arrows labelled F1 and F2.

In more detail, the speaker 100 operates under the principles of Maxwell's equations and Fleming's Left-Hand Rule. As current flows in one direction around the loops in the voice coil 200, the current will flow in opposite directions in the upper and lower portions 151, 152 of the voice coil 200 relative to the magnetic bodies 110, 110', as shown in FIG. 3*a*. As this current flows in the permanent magnetic field produced by the magnetic bodies 110, 110', the forces generated from the upper portion 151 of the voice coil 200 and the lower portion 152 of the voice coil 200 according to Fleming's Left Hand Rule will both contribute to move the diaphragms 140, 140' in a first direction, indicated as direction F1 along the y-axis in FIG. 3*a*.

Subsequently, FIG. 3*b* shows when the alternating current provided to the voice coil 200 by the speaker driving circuit reverses in comparison to FIG. 3*a*. In FIG. 3*b*, the current flows in the opposite direction around the loops of the voice coil 200 to FIG. 3*a*, however the current will still flow in the upper 151 and lower 152 portions of the voice coil 200 in opposite directions. As this current flows around the voice coil 200 in an opposite direction to FIG. 3*a*, but through the same permanent magnetic field induced by the magnetic bodies 110, 110' as before, the forces generated from the upper portion 151 of the voice coil 200 and the lower portion 152 of the voice coil 200 according to Fleming's Left Hand Rule will both contribute to move the diaphragms 140, 140' in the opposite direction as the previous direction F1. This new direction is labelled F2 in FIG. 3*b*.

As such, an alternating current passing through the voice coil 200 will move the voice coil 200 and voice coil plate 150 back and forth along the y-axis, thus moving the first and second diaphragms 140, 140' accordingly. Vibration of each diaphragm 140, 140' due to this movement causes sound to be emitted from each diaphragm 140, 140'. The provision of a first diaphragm 140 and second diaphragm 140' both coupled to the same voice coil plate 150 means that each diaphragm 140, 140' can act as a damper for the other diaphragm 140', 140. No traditional dampers such as 'spiders' may therefore be required in a speaker 100 according to the present invention.

Figure 4:
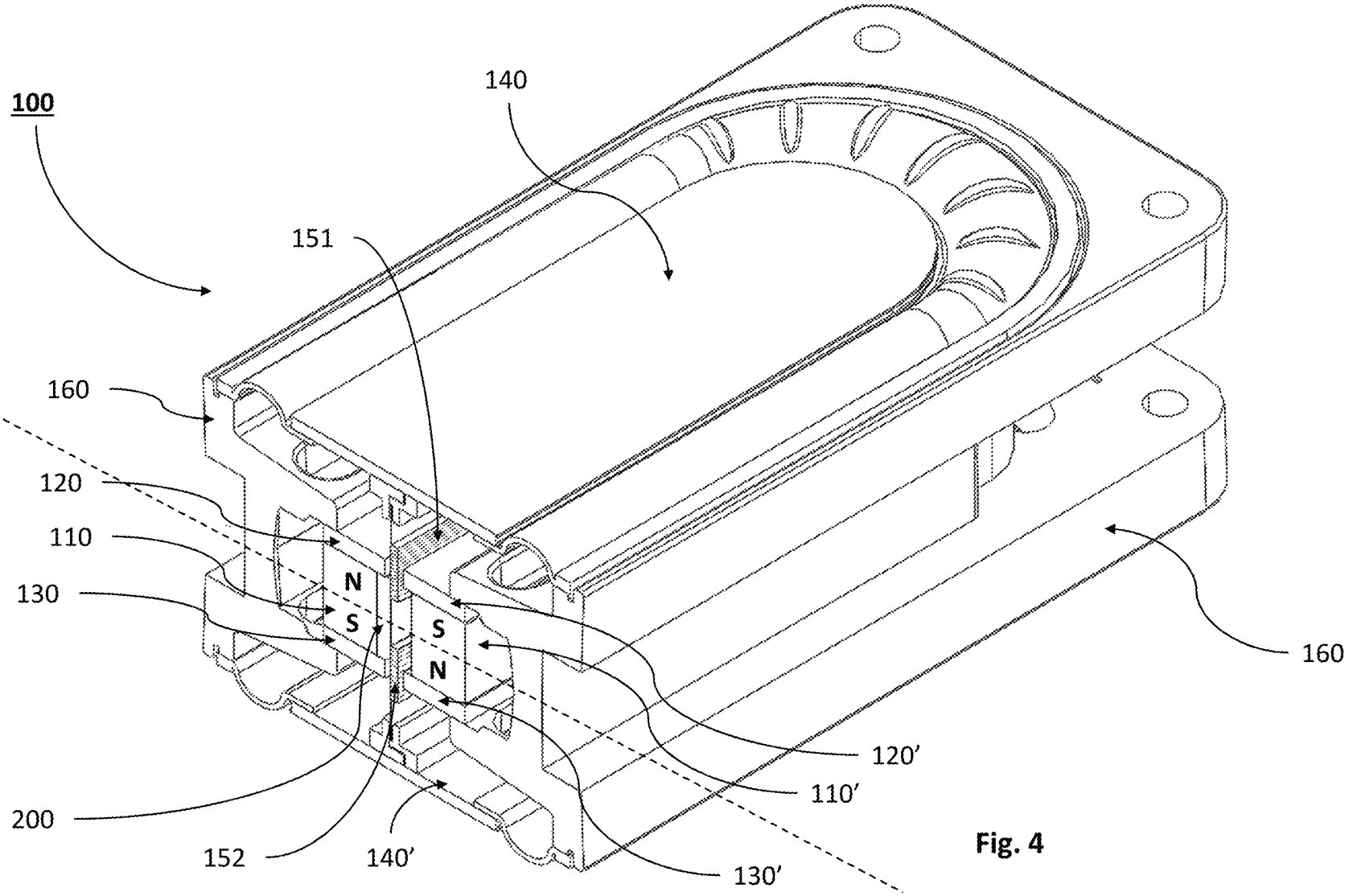
FIG. 4 is a three-dimensional partial view of the bidirectional speaker of FIG. 1.

In some examples, more than one voice coil plate 150 may be included within the same magnetic gap, with each voice coil plate 150 containing any number of voice coils 200 on either or both sides of the voice coil plate 150. FIG. 4 shows a partial three-dimensional representation of the speaker 100 of FIG. 1, illustrating the three-dimensional structure of the various components of the speaker 100.

FIG. 1 shows the first diaphragm 140 and second diaphragm 140' having the same size. This can be useful when the desire is to output substantially the same sound from the first and second diaphragms 140, 140'. In one example, the first diaphragm 140 and second diaphragm 140' may be configured such that they produce sound having substantially the same frequency range. For example, the first diaphragm 140 and the second diaphragm 140' may be substantially the same size, such as in terms of surface area and thickness. The first diaphragm 140 and second diaphragm 140' may also be formed from the same material. However, the speaker 100 of the present invention is not limited to this setup. In other examples, the first diaphragm 140 may have a different size, may have a different shape, and may have a different material than the second diaphragm 140', as shown in FIG. 5.

Figure 5:
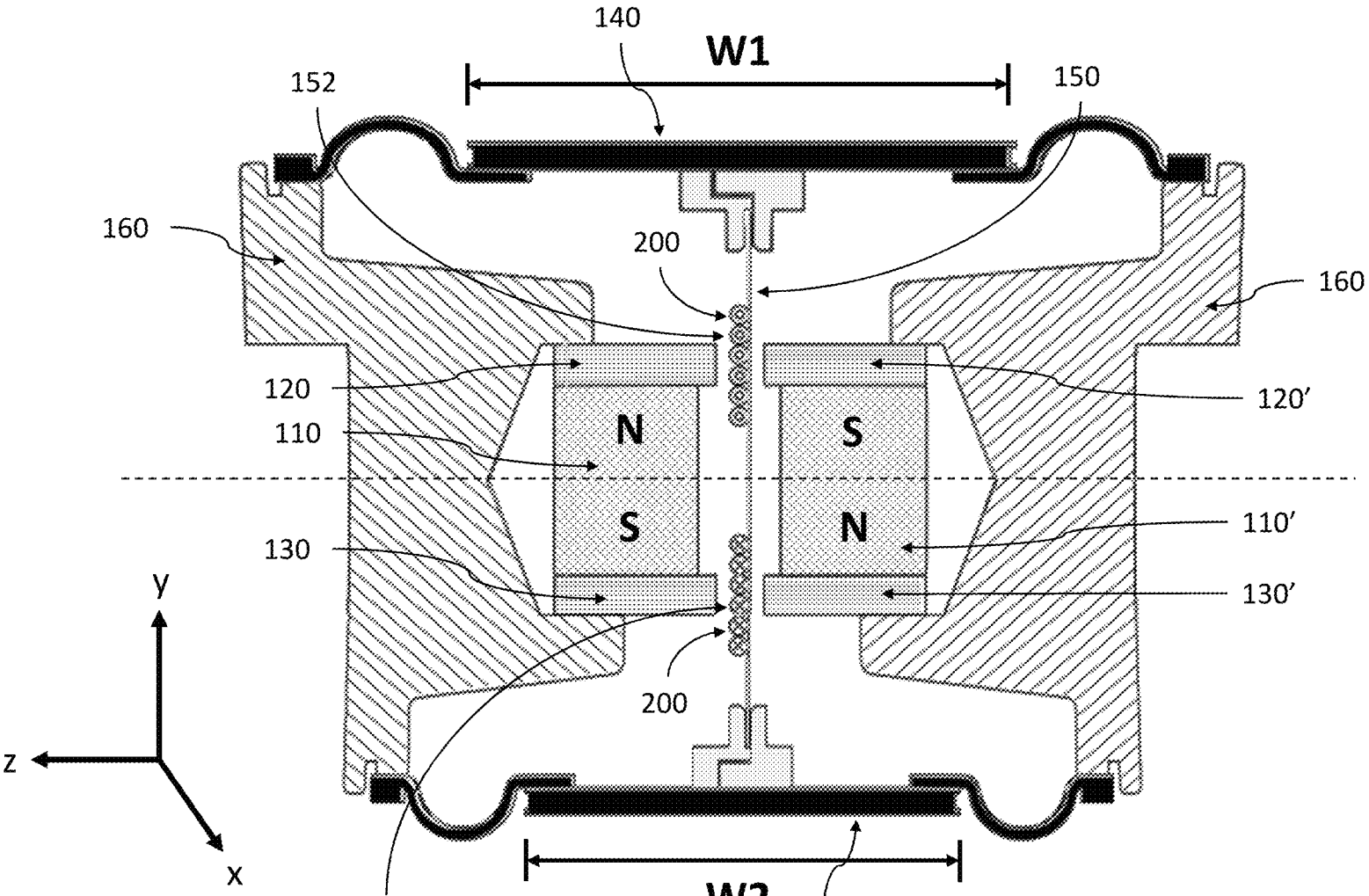
FIG. 5 is a schematic cross-sectional view of a bidirectional speaker according to another embodiment of the invention with diaphragms of different sizes.

FIG. 5 shows a speaker similar to the speaker shown in FIG. 1, however in this example the first diaphragm 140 has a different size to the second diaphragm 140'. In particular, the width W1 of the first diaphragm 140 is more than the width W2 of the second diaphragm 140'. There are a number of different ways in which the first diaphragm 140 may differ to the second diaphragm 140' in order to reproduce a different frequency range. For example, the first diaphragm 140 may have a different width, length, thickness, shape or material to the second diaphragm 140'. One or more of these parameters may be tuned in order to provide a diaphragm 140, 140' having the desired frequency range. FIG. 5 shows the first and second diaphragms 140, 140' arranged parallel to each other, vertically stacked in different planes to each other, and coupled to opposite sides of the voice coil plate 150. Such an arrangement provides a compact speaker 100 which can produce sounds of two different frequency ranges in different directions. The present invention is not limited to a speaker 100 with a single voice coil plate 150. In some examples, the speaker may comprise more than one voice coil plate 150 disposed between the first and second diaphragms 140, 140', as shown in FIG. 6.

Figure 6:
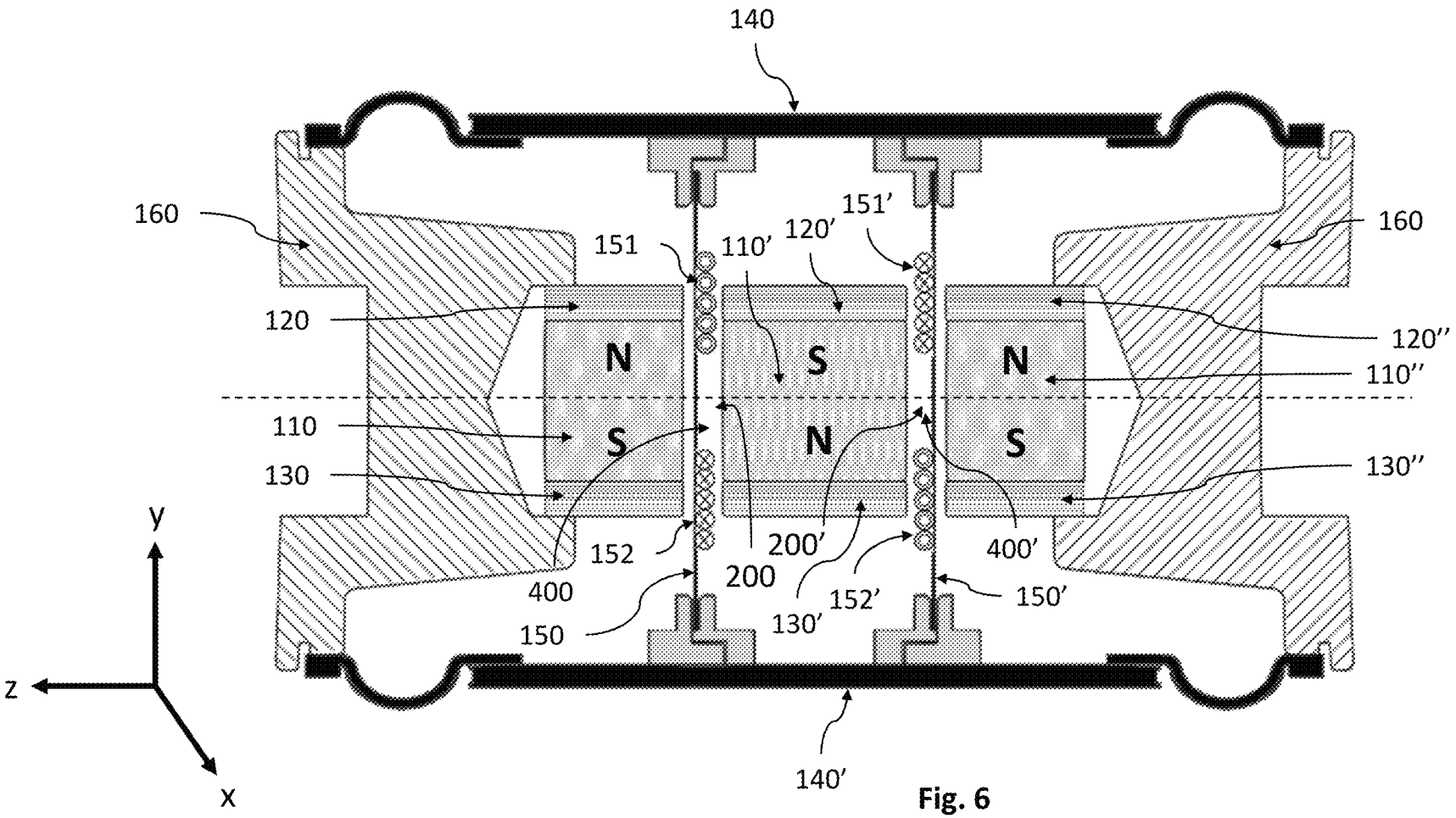
FIG. 6 is a schematic cross-sectional view of a bidirectional speaker according to another embodiment of the invention with more than two magnetic bodies.

FIG. 6 shows a speaker 100 similar to the speaker 100 shown in FIG. 1. However, there is an additional voice coil plate 150' located parallel to the first voice coil plate 150 and separated from the first voice coil plate 150 by the second magnetic body 110'. The additional voice coil plate 150' is arranged in a similar orientation to the first voice coil plate 150 but is located in a gap 400' formed between the second magnetic body 110' and a third magnetic body 110". The second and third magnetic bodies 110', 110" are arranged and orientated such that each polarity of the third magnetic body 110" is located laterally opposite the opposite polarity of the second magnetic body 110', separated by the gap 400' formed between them. An upper end of the additional voice coil plate 150' is coupled to the first diaphragm 140 while a lower end of the additional voice coil plate 150' is coupled to the second diaphragm 140', similar to the first voice coil plate 150.

The additional voice coil plate 150' is similar to the first voice coil plate 150. However, as can be seen in FIG. 6, the current supplied to the voice coil 200' of the additional voice coil plate 150' flows in the opposite direction around the voice coil 200' to the current supplied to the voice coil 200 of the first voice coil plate 150. This ensures that the forces induced in the first voice coil plate 150 and the additional voice coil plate 150' by the magnetic fields are in the same direction along the y-axis, thereby each diaphragm 140, 140' is only moved in one direction at a time by the voice coil plates 150, 150'. When the current in the first voice coil 200 reverses direction, so too does the current in the second voice coil 200'.

An alternating current signal will move the diaphragms 140, 140' up and down in conjunction with one another as it is applied to the voice coils 200, 200'. Each voice coil 200, 200' will contribute an additive force when implemented in this manner, which can boost the sound output by the speaker 100 in comparison to a similar speaker 100 with a single voice coil plate 150.

In general, the speaker 100 can include more than two magnetic bodies 110, 110', each vertically magnetized and placed near each other, separated by a predefined distance, in an alternating fashion such that the opposite poles of each pair of proximate magnetic bodies 110, 110' are facing one another. Between each pair of proximate magnetic bodies 110, 110', the predefined separation space or gap 400, 400' contains one or more voice coil plates 150, 150', each with one or more voice coils 200, 200' wound and attached to either or both sides of the respective voice coil plate 150, 150'. Each voice coil plate 150, 150' is attached to the first diaphragm 140 along its top edge and second diaphragm 140' along its bottom edge, such that no additional damper component is required. Voice coil plates 150, 150' in different magnetic gaps 400, 400' may be attached to different diaphragms 140, 140' on the same side of the speaker 100 structure.

Figure 7:
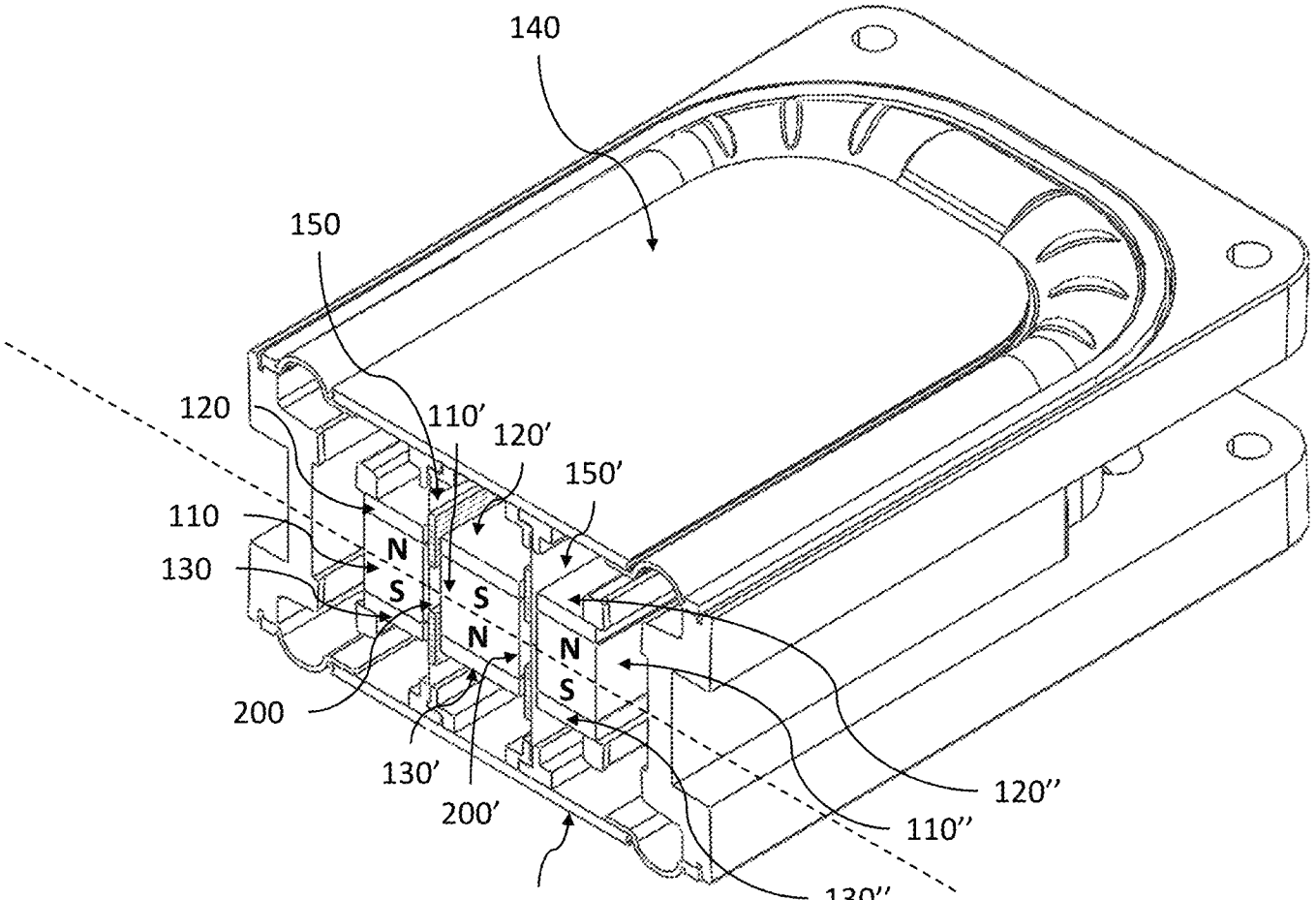
FIG. 7 is three-dimensional partial view of the bidirectional speaker of FIG. 6.

FIG. 7 shows a partial three-dimensional representation of the speaker 100 of FIG. 6, illustrating the three-dimensional structure of the various components of the speaker 100. The second diaphragm 140' is located parallel to the first diaphragm 140 underneath the lower plates 130, 130' and 130" and coupled to voice coil plates 150 and 150'. According to aspects of the invention, the speaker 100 may further include an enclosure 500.

Figure 8:
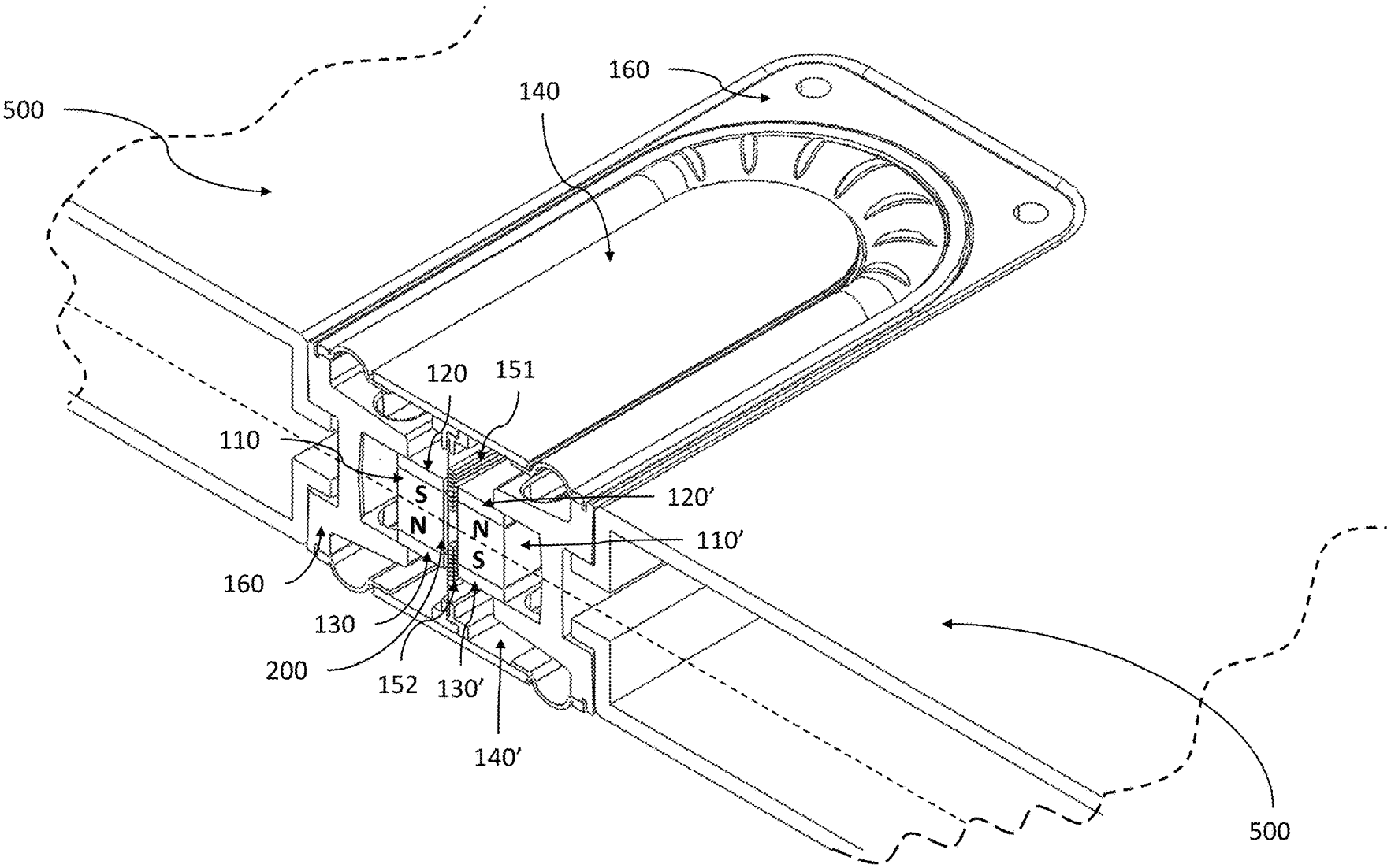
FIG. 8 is a schematic cross-sectional view of a bidirectional speaker having an enclosure and baffle according to embodiments of the invention.
Figure 9:
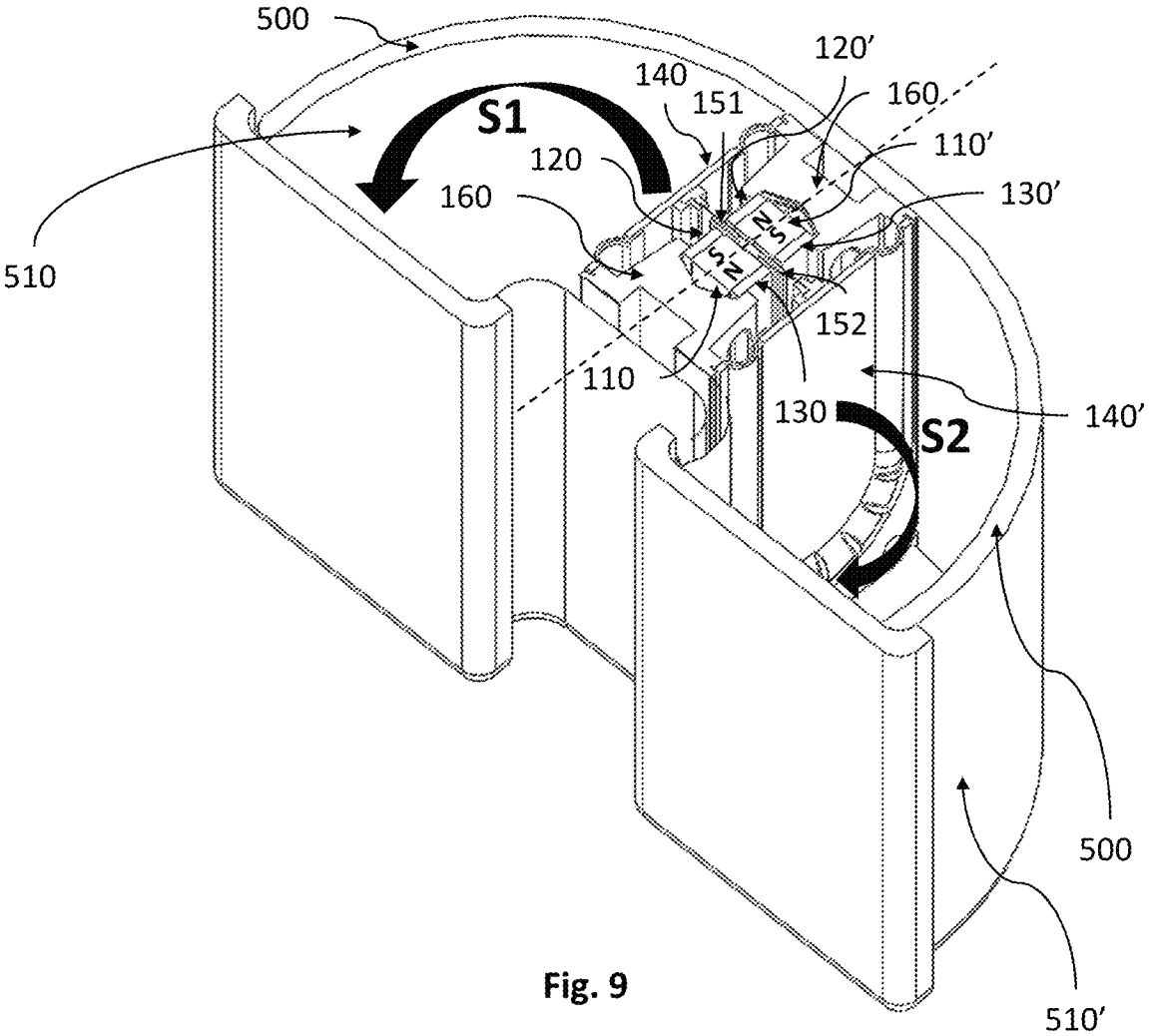
FIG. 9 is a schematic cross-sectional view of a bidirectional speaker having another type of enclosure according to embodiments of the invention.

FIGS. 8 and 9 show bidirectional speakers 100 in accordance with the present invention provided with exemplary different acoustic enclosures 500. A bidirectional speaker 100 according to the present invention can generate sound from a pair of diaphragms 140, 140' facing away from each other. However, the sound emitted by each diaphragm 140, 140' can be output in any direction and at any angle by modifying the enclosure structure 400. With the bidirectional speaker 100 design, since the diaphragms 140, 140' work on both sides of the speaker 100, they provide an enclosure on the top and bottom of the speaker thereby enabling the enclosure 500 to be made exclusively around the sides of the speaker, as shown in FIG. 8. This will ultimately allow for the same motor geometry to be contained in a thinner enclosed system. The enclosure 500 may be of the sealed or ported/vented type, or another suitable design. The enclosure 500 of the bidirectional speaker depicted in FIG. 8 is coupled to and surrounds the exterior of the frame 160, which exposes the first and second diaphragms 140, 140'.

In FIG. 9, even though the upper diaphragm 140 and the lower diaphragm 140' alternate in producing sound in two opposite directions, the actual output of the speaker can be in any direction at any angle by modifying the enclosure 500 structure. For example, by providing an enclosure 500 comprising at least a first acoustic guide 510 configured to direct the sound output by the first diaphragm 140 in a particular direction and a second acoustic guide 510' configured to direct the sound output by the second diaphragm 140' in the same particular direction, it is possible to approximately double the speaker's output in one direction, as illustrated in FIG. 9. Arrow S1 shows the sound emitted from the first diaphragm 140 being redirected by a first acoustic guide 510 to be output in a first direction, in this example perpendicular to the first diaphragm 140. Arrow S2 shows the sound output from the second diaphragm 140' being redirected by a second acoustic guide 510' to be output in substantially the same first direction as the sound redirected by the first acoustic guide 510.

In some examples, the enclosure 500 may be a double-sided infinite baffle arranged around a periphery of the first diaphragm 140 and the second diaphragm 140' to acoustically isolate sounds emitted by the first diaphragm 140 from sounds emitted by the second diaphragm 140', as shown in FIG. 8, for example. Such an implementation could find use in an application where simultaneous indoor and outdoor broadcasting of sound is required, in a conferencing environment to play sound to adjacent rooms, or any other reasonable implementation where sound in two isolated directions would be useful, not limited to the applications mentioned here. It will be appreciated that the above described example embodiments are purely illustrative and are not limiting on the scope of the invention. Other variations and modifications will be apparent to persons skilled in the art upon reading the present application.

Moreover, the disclosure of the present application should be understood to include any novel features or any novel combination of features either explicitly or implicitly disclosed herein or any generalization thereof and during the prosecution of the present application or of any application derived therefrom, new claims may be formulated to cover any such features and/or combination of such features.

What is claimed is:

1. A speaker comprising:

a frame;

a first magnetic body and a second magnetic body each coupled to the frame;

a first voice coil plate that has at least one voice coil wound and coupled to the first voice coil plate, and is placed in between the first magnetic body and the second magnetic body that have been spaced at a minimum distance so that the first voice coil plate will be able to move due to Fleming's left hand law; wherein the first magnetic body and the second magnetic body is arranged so that the opposite polarity of each body is facing each other; and a first diaphragm is coupled to a first end of the $1^{st}$ coil plate and a second diaphragm is coupled to the second end of the 1st voice coil plate.

2. The speaker according to claim 1, wherein the second diaphragm is a different size to the first diaphragm.

3. The speaker according to claim 1, further comprising at least one additional coil plate;

wherein the at least one additional voice coil plate has at least one voice coil made of a conductive material such as copper, a printed circuit board, a flexible printed circuit board, or any other conductive material wound on or inside and coupled to said additional voice coil plate, and wherein the at least one additional voice coil plate is coupled to the first diaphragm and the second diaphragm.

4. The speaker according to claim 3, further comprising a specified number of magnetic bodies, N, coupled to the frame, wherein each additional magnetic body and corresponding previous magnetic body are spaced apart by a predetermined distance from each other to form an additional gap, wherein each additional magnetic body and corresponding previous magnetic body are arranged such that opposite polarities of the additional magnetic body and the corresponding previous magnetic body are provided at adjacent lateral positions, and wherein the at least one additional voice coil plate is located in the gap between each proximate pair of magnetic bodies.

5. The speaker according to claim 3, further comprising a hollow or solid double-sided infinite baffle arranged around peripheries of the first diaphragm and second diaphragm to acoustically separate sounds output by the first diaphragm from sounds output by the second diaphragm.

6. The speaker according to claim 3, further comprising an enclosure configured to guide sound emitted by the first diaphragm and sound emitted by the second diaphragm in substantially the same direction.

7. The speaker according to claim 3, wherein the speaker does not comprise of a speaker damper.

* * * * *